US006203369B1

(12) United States Patent
Feldman

(10) Patent No.: US 6,203,369 B1
(45) Date of Patent: Mar. 20, 2001

(54) HIGH FREQUENCY CABLE CONNECTOR HAVING LOW SELF-INDUCTANCE GROUND RETURN PATHS

(75) Inventor: Steven Feldman, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/426,440

(22) Filed: Oct. 25, 1999

(51) Int. Cl.[7] ..... H01R 9/03
(52) U.S. Cl. ..... 439/579; 439/610
(58) Field of Search ..... 439/578, 610, 439/579, 101, 108, 608

(56) References Cited

U.S. PATENT DOCUMENTS

| | | | |
|---|---|---|---|
| 3,993,394 | 11/1976 | Cooper | 339/136 |
| 5,090,911 | 2/1992 | Welsh | 439/79 |
| 5,184,965 | 2/1993 | Myschik et al. | 439/578 |
| 5,380,216 | 1/1995 | Broeksteeg et al. | 439/352 |
| 5,441,424 | 8/1995 | Morlion et al. | 439/581 |
| 5,460,533 | 10/1995 | Broeksteeg et al. | 439/101 |
| 5,632,634 | 5/1997 | Soes | 439/101 |
| 5,743,765 | 4/1998 | Andrews et al. | 439/608 |
| 5,766,036 | 6/1998 | Ahmad et al. | 439/578 |
| 5,775,924 | 7/1998 | Miskin et al. | 439/98 |

FOREIGN PATENT DOCUMENTS

| | | | |
|---|---|---|---|
| 0 562 691 A1 | 3/1993 | (EP) | H01R/17/12 |
| 0 446 980 B2 | 5/1999 | (EP) | H01R/23/68 |

*Primary Examiner*—Gary Paumen
*Assistant Examiner*—Phuong Chi Nguyen
(74) *Attorney, Agent, or Firm*—Matthew B. McNutt

(57) ABSTRACT

An electrical connector for an electrical signal transmission cable having a signal conductor and a ground shield. The connector includes a one-piece housing of electrically conductive material which is folded to form first and second enclosures that are separated by a central open section. Ground contacts extend from the front edge of each enclosure into the central open section for making contact with a ground pin. A one-piece dielectric connector body holding signal contacts slides into the one-piece housing such that a signal contacts is positioned within the first and second enclosures.

8 Claims, 6 Drawing Sheets

HIGH FREQUENCY CABLE CONNECTOR HAVING LOW SELF-INDUCTANCE GROUND RETURN PATHS

BACKGROUND OF THE INVENTION

The present invention relates to a high frequency electrical connector for a cable of the type having a signal conductor and a ground shield, such as a coaxial cable.

Separable coaxial to coaxial cable terminations are expensive due to construction techniques and materials required by high bandwidth (typically three to six GHz) applications. Typically available separable coaxial cable terminations are also unsuitable as "high density" interconnects because their relatively large circular cross sections, dictated by impedance control and signal propagation considerations, prevent dense signal line spacing. As a result of these disadvantages of separable coaxial to coaxial terminations, and as a result of the need for high density interconnects in current high performance applications, a connector which provides a cost and performance compromise has been developed between coaxial cable terminations and high density "signal-ground-signal" interconnects. This connector is referred to as a shielded controlled impedance (SCI) interconnect.

An SCI interconnect is typified by the 1×2 single coaxial cable connector described in U.S. Pat. No. 5,184,965. In the '965 patent, a sheet metal shield box encloses one signal socket contact and one ground socket contact, each designed to mate with a header pin. The ground socket makes electrical contact with the inside of the metalized shield box via a spring arm to provide continuity from the header pin through the shield box to the coaxial cable shield. By grounding the shield box internally and in only one location, the cross-sectional bulk of a typical symmetrical coaxial cable termination is eliminated.

As the need for greater density of the interconnects has increased, SCI connectors having an increased number of signal contacts have been introduced. FIGS. 1(*a*)–1(*d*) illustrate such an SCI connector. In a prior art design shown in FIGS. 1(*a*)–(*d*), two coaxial cables share a common ground contact within the connector (referred to as a 1×3 connector) to provide a higher density interconnect than two 1×2 connectors stacked together (e.g., one less ground pin is required). Like the 1×2 SCI connector described above, each signal line is fully enclosed by shielding.

The 1×3 SCI connector as illustrated in FIGS. 1(*a*)–1(*d*) is constructed from many components in a labor intensive manner. For example, the shield boxes 2 for each signal connector (not shown) are formed separately and held together by a welded spring plate 4 in front and a solder bridge 6 in back. In addition, the ground pin contact 8 is attached to only one of the separate shield boxes, thereby possibly increasing self-inductance and cross talk within the connector. Additional components, such as an adjacent box grounding contact 9 must be attached as separate components by welding or soldering. As can be seen, the connector requires a labor intensive and expensive assembly process. In addition, the large number of individual components leads to a greater likelihood of connector failure or poor performance due to improper assembly.

A high frequency cable connector for coaxial or twinaxial shielded cables is shown in U.S. Pat. No. 5,632,634. The '634 patent provides a high density electrical connector for coaxial or twinaxial cables, where the connector has an outer shield that may be electrically connected to a ground pin in a mating connector. The connector provides at least two inner insulating housings separately surrounded by an outer shielding member. The inner insulating housings have inner signal contacts, and the outer shielding members are commonly grounded by way of a grounding spring clip positioned between the outer shielding members.

The connector described in the '634 patent, while providing electrical shielding to the connection, is not capable of providing the same characteristic impedance for all signal lines. In particular, the distance between the ground return path and each of the signal conductors is not equal. That is, the outer signal conductors are further from the ground return path than are the inner signal conductors. This means that the signal conductors do not experience a uniform impedance across the connector, and any signals traveling through the connector will experience degradation as a result. Further, the grounding spring clip of the '634 patent is not positioned for controlling the impedance of the connector. Specifically, the grounding spring clip does not make contact with the outer shield member near the front edge of the connector. Rather, the grounding spring clip contacts the shield member well behind the front edge of the connector. This makes the ground return path of the connector much longer than the signal path through the connector, thereby causing an increased self-inductance and increased impedance within the connector.

The above prior art connectors do not provide adequate performance characteristics for high performance systems. Inadequate performance characteristics include, for example, excessive "ground bounce", the inability to control the impedance in the connector without significant discontinuities, or to provide connector bandwidth equal to the system in which the connector is used. For example, any difference in the lengths of the signal path and the ground path through the connector causes increased self-inductance in the connector, and hence an increase in ground bounce. Ground bounce refers to the transient voltage appearing across a portion of a signal return path when return currents from rising or falling signals pass through areas of significant inductance. This transient voltage results in signal degradation and crosstalk. It is therefore advantageous to position the grounding contacts of the connector as close as possible to the engagement point of the grounded component, e.g., the ground pin of the mating pin header. In this manner, the lengths of the signal and ground paths are kept as close as possible to the same length, thereby minimizing any self-inductance within the connector, and also minimizing the impedance variation within the connector.

It is also important to minimize any variation in the distance separating the signal path and its ground return path as the signal moves through the connector. If the spacing between the signal path and the ground path varies from one signal path to another, the signal line will experience a different impedance, thus causing degradation in the system using the connector. Such impedance variations limit the bandwidth of the connector and are not acceptable in many high performance systems. Other factors important in providing a low impedance current return include the width of the current return path. That is, a current return path having a larger cross section is preferred over one with a smaller cross section.

It is apparent that what is needed is a high density, high frequency connector for shielded cables that provides an improved performance and ease of assembly over currently available connectors, and which provides a low self-inductance ground return path.

SUMMARY OF THE INVENTION

The present invention provides an electrical connector for a cable of the type having a signal conductor and a ground shield, such as a coaxial cable. The connector is specially suited to high frequency, high performance systems, as it prevents excessive ground bounce, allows control of the impedance in the connector without significant discontinuities, and is easy to assemble and to use.

In the connector according to the invention, a one-piece housing is formed from electrically conductive material folded to create a first enclosure and a second enclosure. The first and second enclosures are spaced apart by a central open section. Ground contacts are integrally formed with the front edge of the one-piece housing and are bent to extend into the central open section. A dielectric connector body having spaces to receive first and second signal contacts is adapted to be inserted into the one-piece housing, such that the first and second signal contacts are positioned within the first and second enclosures, respectively.

The housing of the electrical connector preferably includes locking tabs that extend from the housing to engage the connector body. The locking tabs prevent the housing form unfolding, and aid in retaining the connector body within the housing. The housing and body of the connector are further secured by soldering the housing to the shield of the coaxial cables being terminated.

In an alternate embodiment, the housing is provided with additional grounding contacts that extend beyond the periphery of the connector assembly, for example, to make contact with a conductive header shroud. The use of additional grounding contacts increase the potential bandwidth of the connector assembly.

The connector may also be provided with a cantilever beam contact on its bottom surface for making contact with the conductive housing of an adjacent connector assembly in a stack of connector assemblies. In this manner, it is ensured that each connector is at the same ground potential.

The inventive connector provides distinct advantages over prior art connectors, and in particular provides the ability to control the impedance in the connector, and provide a connector bandwidth that is equal to the system in which the connector is used.

DETAILED DESCRIPTION OF THE INVENTION

Figure 1A:
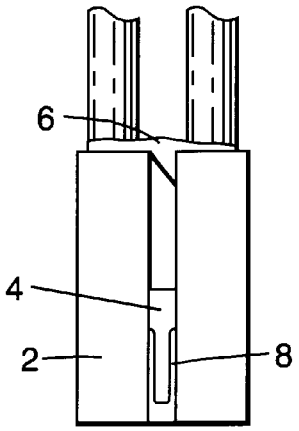
Fig. 1a (Prior Art)
FIGS. 1*a*–1*d* illustrate a prior art high frequency SCI connector.
Figure 1B:
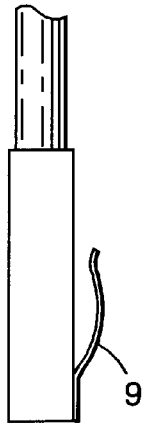
Fig. 1b (Prior Art)
Figure 1C:
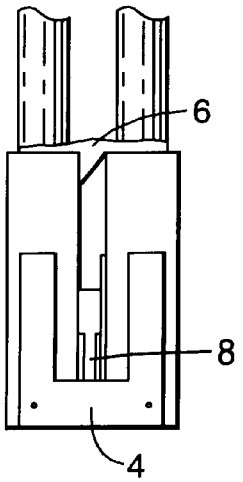
Fig. 1c (Prior Art)
Figure 1D:
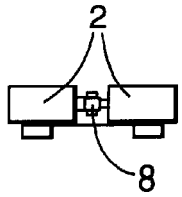
Fig. 1d (Prior Art)
Figure 2:
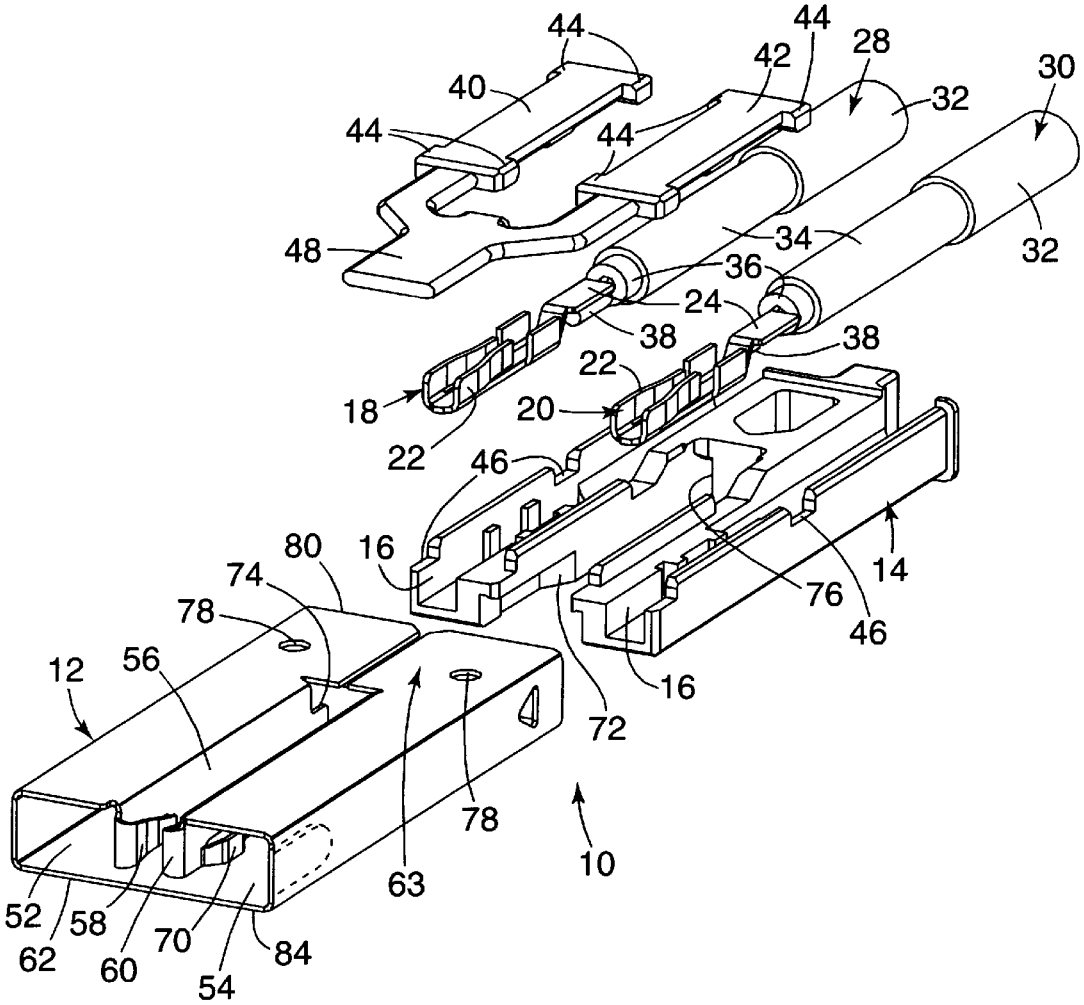
FIG. 2 is an exploded perspective view of the cable connector of the present invention.

As shown in FIG. 2, an electrical connector assembly 10 includes a housing 12 formed from a conductive material, preferably metal, and a body portion 14 formed from a dielectric or insulative material. Connector body 14 includes recesses 16 adapted to receive signal contacts 18, 20. The signal contacts 18, 20 are bent of sheet metal in a suitable manner. Signal contacts 18, 20 include a front plug-in portion 22, which is U-shaped in cross-section for receiving a mating pin (not shown). Contacts 18, 20 each also include a rear connection portion 24 for attachment to a signal conductor, for example, by welding or soldering. It appears unnecessary to describe contacts 18, 20 in greater detail, since the structure and function thereof are already well known in the art.

Coaxial cables 28, 30 are each prepared at one end for connection to signal contacts 18, 20, respectively. As is commonly known, coaxial cables 28, 30 include an outer jacket 32, a shield 34, a dielectric layer 36 and a central conductor 38. As shown in FIG. 2, conductors 38 rest against the rear connection portions 24 of signal contacts 18, 20 and are attached thereto by soldering or welding. The preparation of the cable ends are such that shields 34 are terminated at a distance from contacts 18, 20, with a portion of the dielectric layer 36 therebetween. The preparation of coaxial cables 28, 30 can be carried out by an automated process (not shown).

After coaxial cables 28, 30 are connected to signal contacts 18, 20, respectively, the signal contacts 18, 20, and coaxial cables 28, 30 are placed in the recesses 16 of body 14. The contacts 18, 20 are securely retained in place by signal contact covers 40, 42. Contact covers 40, 42 include snap-in tabs 44, which engage cover retaining channels 46 in body 14. Contact covers 40, 42 may be temporarily joined together by an application handle 48, which is used during assembly of the contact covers 40, 42 and connector body 14. The cover application handle 48 is preferably frangibly attached to signal contacts covers 40, 42 so that application handle 48 may be easily removed after contact covers 40, 42 are securely engaged with body 14.

Connector housing 12 is formed from a single piece of electrically conductive material and is folded to create two separate enclosures 52, 54, which are spaced apart by a central open section 56. Central open section 56 provides an air dielectric electrical isolation between the unshielded portion of signal conductors 38. Ground contacts 58, 60 extend from the front edge 62 of housing 12 and are folded back into open central section 56. Ground contacts 58, 60 provide cantilever beam contacts for making electrical contact with a mating ground pin or ground blade. As seen in FIG. 2, housing 12 is formed such that enclosures 52, 54 do not extend the entire length of the housing 12. Rather, the back portion of housing 12 is folded to form a single enclosure portion 63 around the exposed shields 34 of cables 28, 30. By providing single enclosure portion 63, body 14 may be formed as a single piece, making it unnecessary to provide separate body portions for each signal contact 18, 20.

Body 14 is inserted in housing 12 by simply sliding the components together. Housing 12 may be provided with features for retaining body 14 within housing 12, to prevent dislodging of the body 14 during installation or removal of the connector, or to prevent housing 12 from unfolding. Specifically, housing 12 may be provided with a front body lock 70, which engages a mating recess 72 on body 14, and a rear body lock 74, which engages mating slot 76 in body 14. In this manner, body 14 is maintained in housing 12, and housing 12 is prevented from unfolding during rough use of the connector.

Figure 3A:
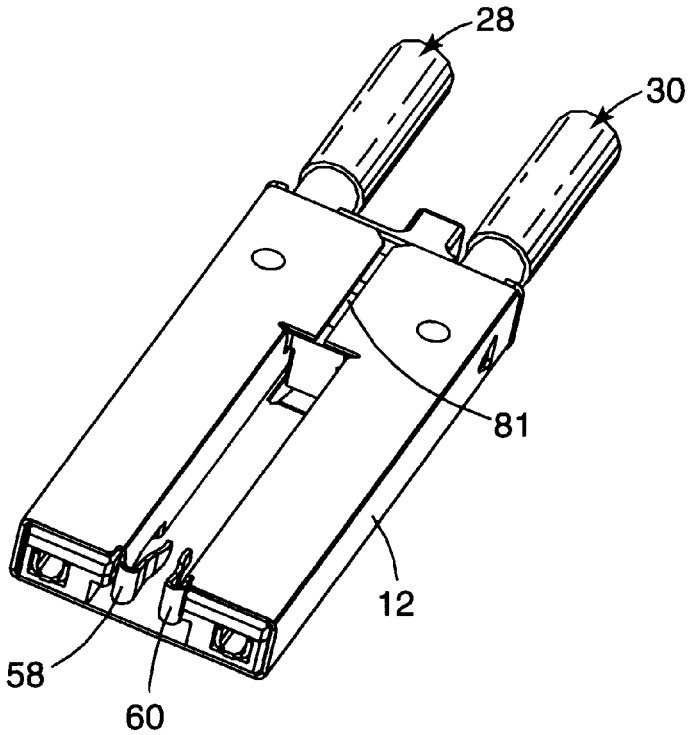
FIGS. 3*a* and 3*b* are perspective views of the assembled connector of the present invention.
Figure 3B:
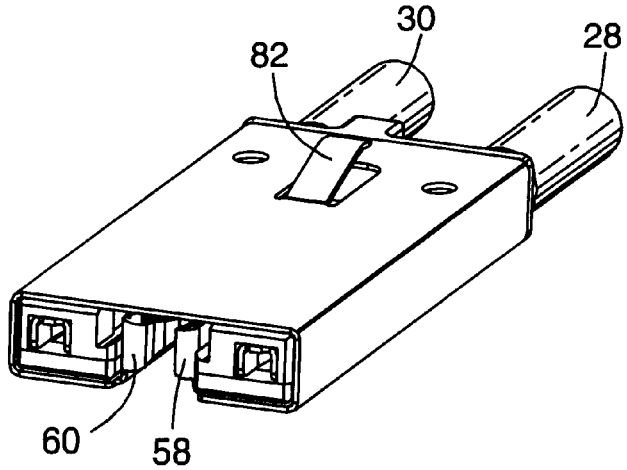

The assembled housing 12 and body 14 are shown in FIGS. 3*a* and 3*b*. After body 14 with coaxial cables 28, 30 is inserted into housing 12, coaxial cable shields 34 are connected to housing 12, such as by soldering or welding. This may be accomplished by applying solder paste in openings 78 in housing 12. Openings 78 are positioned over coaxial shield 34. Preferably, holes 78 are located close enough to rear edge 80 of housing 12 such that the solder wicks between housing 12 and coaxial shield 34 all the way to rear edge 80. In this manner, the ground path return length is kept as close as possible to the length of the signal path, thereby minimizing the connector's impedance. Additionally, the creation of a long solder filet between housing 12 and coaxial cable shields 34 further secures body 14 within housing 12 and prevents pullout of cables 28, 30 from the assembly.

As seen in FIG. 3*b*, housing 12 may optionally be provided with a cantilever beam contact 82 on its bottom surface 84. Contact 82 is preferably integrally formed with housing 12, and is simply folded out of the plane of bottom surface 84 if contact with an adjacent connector assembly (not shown) is desired. For example, in a stack of connector assemblies, it is desirable to provide electrical contact between the conductive housings 12 of the connectors to ensure that each connector is at the same ground potential. Beam contact 82 is preferably positioned such that it simultaneously contacts both sides of housing seam 81 when two or more connector assemblies are stacked together. In this manner, the length of the ground path to each enclosure 52, 54 is maintained at the same length.

Figure 4:
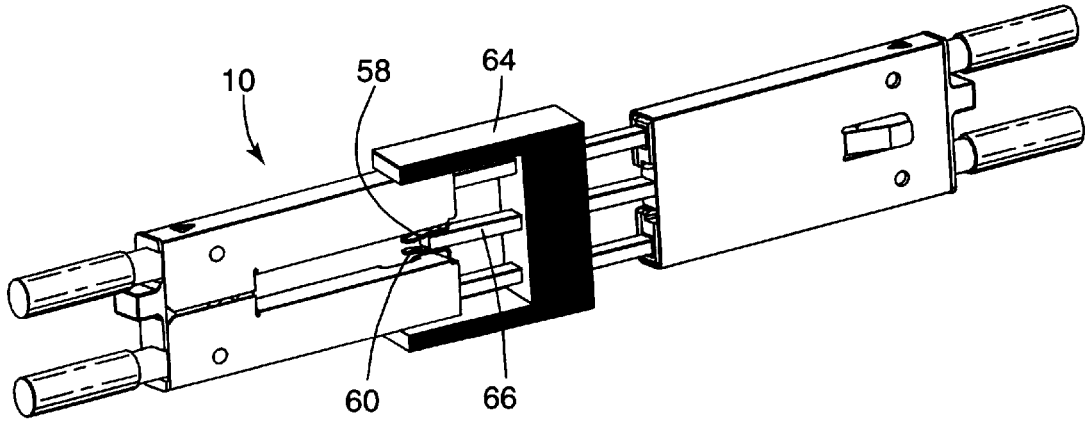
FIG. 4 is a perspective view of the inventive cable connector engaging a pin header.

The assembled connector assembly 10 is shown in FIG. 4 engaging a pin header 64. As can be seen in FIG. 4, ground contacts 58, 60 contact grounded blade 66 as the header 64 and connector 10 are engaged.

Figure 5:
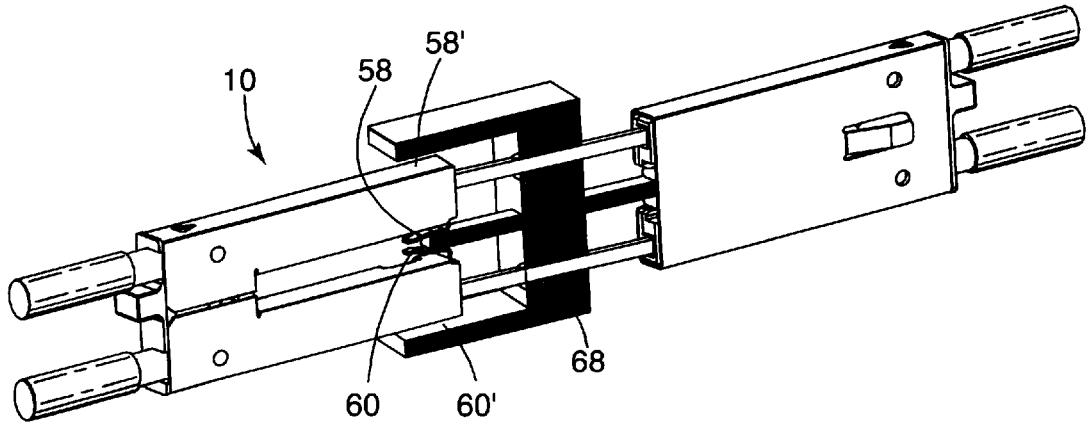
FIG. 5 is perspective view of an alternative embodiment of the inventive cable connector engaging a conductive pin header.

Housing 12 may also optionally be provided with additional grounding contacts 58', 60', as shown in dashed lines in the figures. Optional ground contacts 58', 60' may be desired, for example, when connector assembly 10 is used in conjunction with a conductive header shroud 68 as shown in FIG. 5. The addition of ground contacts 58', 60' provides additional ground contact points between the housing 12 and conductive header, thereby increasing the potential bandwidth of the connector assembly.

Figure 6:
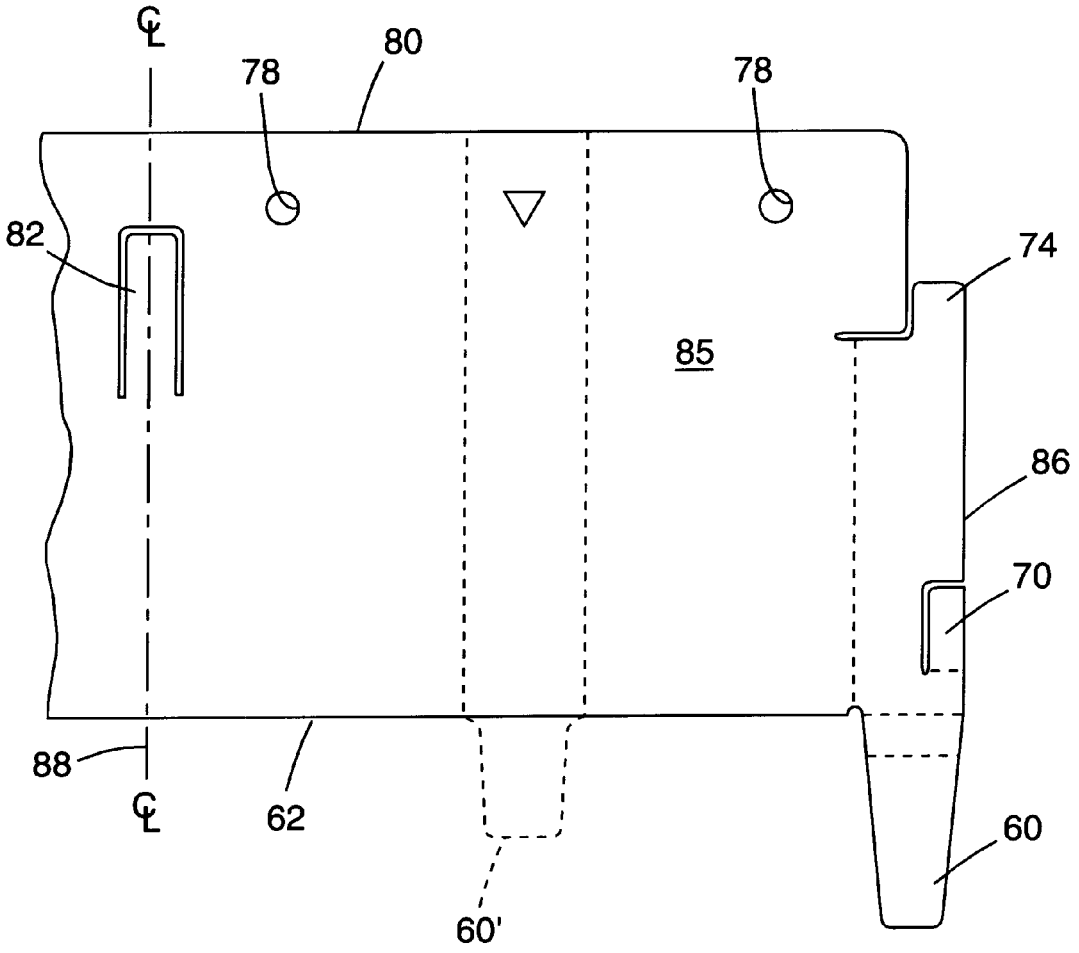
FIG. 6 is a plan view of a sheet blank prior to forming the connector housing.
Figure 7A:
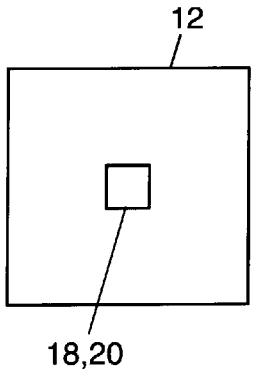
FIGS. 7*a*–7*c* are schematic illustrations of coaxial, microstrip and stripline transmission geometries.
Figure 7B:
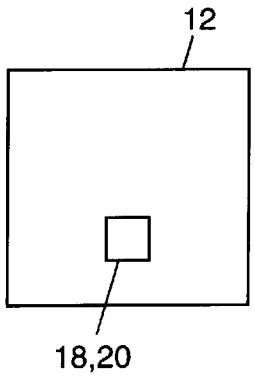
Figure 7C:
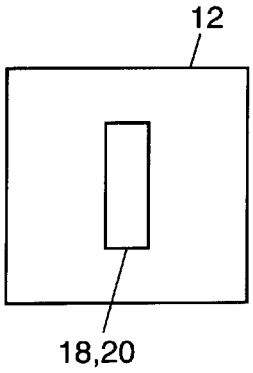
Figure 8:
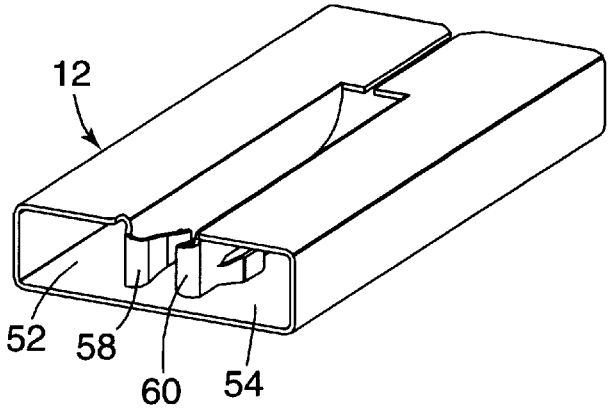
FIG. 8 is a perspective view of an alternate embodiment of the housing of the inventive cable connector.

As described above, housing 12 is preferably formed from a single piece of flat sheet metal. As shown in FIG. 6, housing 12 starts as a flat sheet of material having features which will be formed into ground contacts 58, 60, body locks 70, 74 and adjacent box contact 82. The dashed lines indicate where the blank 83 will be bent. Only one half of the symmetrical blank 83 is shown, with the centerline being designated by line 88. As illustrated in FIG. 6, the completed housing 12 is formed by first folding each ground contact member 58, 60 toward the bottom surface 84 and rear edge 80 of the blank 83. Front body lock 70 is deformed at this same time in a direction toward the top surface 85 of the flat blank 83. The lateral edges 86 of the sheet stock are then folded toward the center of the top surface to form separate enclosures 52, 54 and single enclosure portion 63. Upon completion of the folding process, ground contacts 58, 60 are positioned such that they extend into central open section 56, while front body locks 70 extend into each enclosures 52, 54. If housing 12 is to be provided with an adjacent box contact 82, the adjacent box contact 82 will also be deformed prior to folding the lateral edges 86 to form the enclosures 52, 54. It will be noted that although enclosures 52, 54 are shown as square or rectangular in the FIGS. 2 through 7(*c*), enclosures 52, 54 may also be provided with a circular cross-section if desired, as shown in FIG. 8, especially when a coaxial transmission geometry is desired.

The configuration of connector assembly 10 provides several advantages over prior art connectors, such as that shown in U.S. Pat. No. 5,632,634. In the present invention, by forming ground contacts 58, 60 integrally with housing 12, a wider conductive path (and hence, lower inductance) may be provided to the connector. Additionally, by placing ground contacts 58, 60 at the front edge 62 of housing 12, the length of the ground return path is kept as close as possible to the length of the signal path. This further reduces the self-inductance within the connector, and aids in controlling the connector impedance. As previously noted, when the impedance control is improved, the connector bandwidth increases, which is critical to high performance, high frequency systems. The use of two ground contacts 58, 60, each associated with its own enclosure 52, 54, respectively, further increases the performance of the connector assembly.

By selecting the shape and placement of the signal contacts within housing 12 and body 14, the design described herein may be used to provide any desired cross-sectional transmission geometry. For example, connector assembly 10 may be used to provide a coaxial, microstrip, or stripline relationship between the ground plane provided by housing 12 and signal contacts 18, 20. Schematic representations of these three geometries are shown in FIGS. 7(*a*)–7(*c*), respectively. The coaxial shielding may be continued through the connector assembly 10 by positioning the signal contacts centrally within housing 12, and may be enhanced by the use of optional grounding contacts 58', 60'.

The inventive connector assembly described herein may also be used to provide a known microstrip or stripline relationship between the ground plane and the signal contacts 18, 20. The method for determining the impedance of a device having microstrip or stripline geometry is known in the art, and it will be recognized that by maintaining the spacing between the ground plane and signal contacts 18, 20 within each enclosure 52, 54, at a uniform distance, the impedance of connector assembly 10 can be closely controlled and adjusted for optimal connector performance. For example, the impedance can be adjusted by altering the width and thickness of the signal contacts 18, 20, by varying the dielectric constant of the material forming body 14, or by altering the thickness of the material between signal contacts 18, 20 and housing 12.

Although the present invention has been described herein with respect to certain illustrated embodiments, the intention is to cover all modifications, alternative constructions, and equivalents falling within the spirit and scope of the invention.

What is claimed is:

1. An electrical connector for an electrical signal transmission cable of the type having a signal conductor and a ground shield, the connector comprising:

a one-piece housing of electrically conductive material folded to form a first enclosure and a second enclosure, the first and second enclosures spaced apart by a central open section, wherein first and second ground contacts extend from the first and second enclosures, respectively, into the open section, the first and second ground contacts integrally formed from and folded with the one-piece housing for making contact with a ground pin; and a dielectric connector body having spaces to receive first and second signal contacts in a fixed spaced relation to each other, the first and second signal contacts each adapted for connection to respective first and second signal conductors, the dielectric body adapted to be inserted into the one-piece housing such that the first and second signal contacts are positioned within the first and second enclosures respectively.

2. The electrical connector of claim 1, wherein the connector body comprises a single piece.

3. The electrical connector of claim 1, further comprising a locking tab extending from the housing, the locking tab adapted to engage the connector body and prevent the housing from unfolding.

4. The electrical connector of claim 1, wherein the ground contacts extend from a front edge of the enclosures.

5. The electrical connector of claim 1, wherein the enclosures are rectangular in cross section.

6. The electrical connector of claim 1, wherein the enclosures are circular in cross section.

7. The electrical connector of claim 1, wherein the ground contacts are equidistant from their respective signal conductors.

8. The electrical connector of claim 1, further comprising a flexible beam member integrally formed with the housing, the flexible beam member positioned to contact the housing of an adjacent electrical connector in a stack of electrical connectors.

* * * * *